US011781253B1

(12) United States Patent
Wang

(10) Patent No.: US 11,781,253 B1
(45) Date of Patent: Oct. 10, 2023

(54) CIRCULAR KNITTING MACHINE STRUCTURE

(71) Applicant: PAI LUNG MACHINERY MILL CO., LTD., New Taipei (TW)

(72) Inventor: James C.C. Wang, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 0 days.

(21) Appl. No.: 17/833,048

(22) Filed: Jun. 6, 2022

(51) Int. Cl.
*D04B 9/34* (2006.01)

(52) U.S. Cl.
CPC ..... *D04B 9/34* (2013.01)

(58) Field of Classification Search
CPC . D04B 15/06; D04B 9/34; D04B 9/28; D04B 15/82; D04B 15/322; D04B 15/325
See application file for complete search history.

(56) References Cited

U.S. PATENT DOCUMENTS 1,605,895 A * 11/1926 Lawson ..... D04B 9/26 66/146
1,690,268 A * 11/1928 Barth ..... D04B 9/26 66/137
1,758,899 A * 5/1930 Lawson ..... D04B 9/28 66/108 R
1,796,266 A * 3/1931 Lawson ..... D04B 9/28 66/108 R
1,811,849 A * 6/1931 Houseman ..... D04B 15/80 66/137
1,977,590 A * 10/1934 Page ..... D04B 15/06 66/108 R
2,050,962 A * 8/1936 Page ..... D04B 9/26 66/107
2,058,392 A * 10/1936 Seaman ..... D04B 35/04 66/36
2,082,751 A * 6/1937 Lawson ..... D04B 9/28 66/108 R
2,115,929 A * 5/1938 Lawson ..... D04B 15/08 66/107
2,515,505 A * 7/1950 Getaz ..... D04B 9/34 66/224
2,711,090 A * 6/1955 Marlette ..... D04B 9/34 66/108 A
5,862,681 A * 1/1999 Schmidt ..... D04B 9/12 66/106

(Continued)

*Primary Examiner* — Danny Worrell
(74) *Attorney, Agent, or Firm* — Muncy, Geissler, Olds & Lowe

(57) ABSTRACT

A circular knitting machine structure comprises knitting needles and sinkers. Each knitting needle is controlled to move on a first half knitting track or a second half knitting track. A retracting time point of the first half knitting track is later than that of the second half knitting track. One side of the sinker facing the knitting needle is formed with an inclined plane. When the knitting needle is used for knitting, a surface yarn and a bottom yarn are fed therein. When the knitting needle moves on the first half knitting track, a standard plating is knitted without changing the position of the surface yarn. When the knitting needle moves on the second half knitting track, the surface yarn leans against the inclined plane of the sinker transitorily, the position of the surface yarn is changed relatively to the bottom yarn, and an interchanged plating is knitted.

11 Claims, 10 Drawing Sheets

(56) References Cited

U.S. PATENT DOCUMENTS

| | | | | |
|---|---|---|---|---|
| 6,128,930 | A * | 10/2000 | Schmidt | D04B 35/02 66/91 |
| 6,715,325 | B2 * | 4/2004 | Sangiacomo | D04B 15/34 66/93 |
| 9,834,871 | B2 | 12/2017 | Lee | |
| 11,136,698 | B2 | 10/2021 | Lee | |

* cited by examiner

CIRCULAR KNITTING MACHINE STRUCTURE

FIELD OF THE INVENTION

The present invention relates to a circular knitting machine structure, in particular to a circular knitting machine structure which can be used for knitting an interchanged plating by changing a position of a surface yarn.

BACKGROUND OF THE INVENTION

U.S. Pat. No. 11,136,698 discloses a weft knitting machine knitting structure capable of changing positions of yarns. According to the weft knitting machine knitting structure, each of knitting needles is controlled to carry out a first retracting track and a second retracting track; and when each of the knitting needles moves according to the first retracting track, each of the knitting needles is used for knitting a standard plating without changing positions of a surface yarn and a bottom yarn in a needle hook. In a process that each of the knitting needles moves according to the second retracting track, when the positions of the surface yarn and the bottom yarn are not limited by a sinker adjacent to each of the knitting needles, the bottom yarn is stirred by a needle latch, and the bottom yarn is pushed by a nose part of the sinker to change the positions of the surface yarn and the bottom yarn in the needle hook, so that an interchanged plating is knitted.

In another aspect, U.S. Pat. No. 9,834,871 discloses a method of knitting an interchanged plating on a technical positive-side and single-side manner by a flat knitting machine. The method is that a sinker can be used for simultaneously pushing a bottom yarn (i.e. a first color yarn described in the scheme) and a surface yarn (i.e. a second color yarn described in the scheme) to slide downwards for knitting by a front edge of a nose portion in a period that a knitting needle is located at a second retracting segment, so as to form a normal plating (i.e. a standard plating described in the scheme). When a machine head enables the knitting needle to move according to a yarn interchanging and retracting stroke, the sinker can be at a junction of a rear edge of the nose portion and a groove in a period that the knitting needle is located at the yarn interchanging and retracting stroke, and the bottom yarn is stirred up to the position above the surface yarn and then is released for knitting, so as to form an interchanged plating.

Although both the U.S. Pat. Nos. 11,136,698, 9,834,871 can achieve the yarn interchanging purpose, the two schemes are realized by changing the position of the bottom yarn. However, for the current implementation of a circular knitting machine, a space in the needle hook of each of the knitting needles is limited; and when the bottom yarn and the surface yarn are fed into the needle hook, the bottom yarn is closer to the position of the needle latch, and the above position is a narrower part of the space in the needle hook, leading to the problem of unsmooth interchanging of the bottom yarn. Besides, the sinker disclosed in the U.S. Pat. No. 9,834,871 is used for stirring the bottom yarn through two-dimensional movement, but a sinker of the circular knitting machine cannot carry out two-dimensional movement.

SUMMARY OF THE INVENTION

The present invention mainly aims to solve the problem of unsmooth interchanging of yarns caused by that the existing implementation scheme is implemented mainly by changing a bottom yarn.

In order to achieve the above purpose, the present invention provides a circular knitting machine structure, which comprises a plurality of knitting needles and a plurality of sinkers. Each of the plurality of knitting needles comprises a needle hook, each of the plurality of knitting needles is controlled to move on one of a first half knitting track and a second half knitting track, and a retracting time point of the first half knitting track is later than a retracting time point of the second half knitting track. Each of the plurality of sinkers is arranged correspondingly to each of the plurality of knitting needles, patterns of the plurality of sinkers are uniform, and one side of each of the plurality of sinkers facing each of the plurality of knitting needles is formed with an inclined plane, wherein when each of the plurality of knitting needles is used for knitting, a surface yarn and a bottom yarn are fed into each of the plurality of knitting needles, and a position of the surface yarn in the needle hook is higher than a position of the bottom yarn; when one of the plurality of knitting needles moves on the first half knitting track, a standard plating is knitted without changing the position of the surface yarn; and when one of the plurality of knitting needles moves on the second half knitting track, the surface yarn transitorily leans against the inclined plane of one of the sinkers, and the position of the surface yarn is changed relative to the bottom yarn so that an interchanged plating is knitted.

In one embodiment, each of the plurality of sinkers comprises a sinker track, and each sinker track comprises a push-out segment carried out when each of the knitting needles is used for retracting and a pull-back segment carried out following the push-out segment.

In one embodiment, each of the plurality of sinkers is provided with a belly part, a nose part connected with the belly part, and a throat part between the belly part and the nose part; and the inclined plane and a flat plane connected with the inclined plane are formed on one side of the nose part distant from the belly part.

In one embodiment, the circular knitting machine structure comprises at least one knitting cam for providing movement paths for the plurality of knitting needles, and at least one needle selector which is controlled to drive each of the plurality of knitting needles to move on one of the first half knitting track and the second half knitting track.

In one embodiment, the circular knitting machine structure comprises at least one sinker cam for guiding the plurality of sinkers to move.

In one embodiment, each of the plurality of knitting needles is controlled to move on the first half knitting track, the second half knitting track and a plain knitting track. Further, the circular knitting machine structure is provided with the at least one knitting cam for providing movement paths for the plurality of knitting needles, and at least one needle selector which is controlled to drive each of the plurality of knitting needles to move on one of the first half knitting track, the second half knitting track and the plain knitting track.

Through the above implementation of the present invention, compared with conventional use, the circular knitting machine structure has the following characteristic: besides the circular knitting machine structure can enable each of the plurality of knitting needles to move on one of the first half knitting track and the second half knitting track, the problem of blocking of the yarns or unsmooth interchanging of the yarns in a yarn interchanging process is avoided by changing the position of the surface yarn relative to the bottom yarn.

DETAILED DESCRIPTION OF THE PREFERRED EMBODIMENTS

Figure 1:
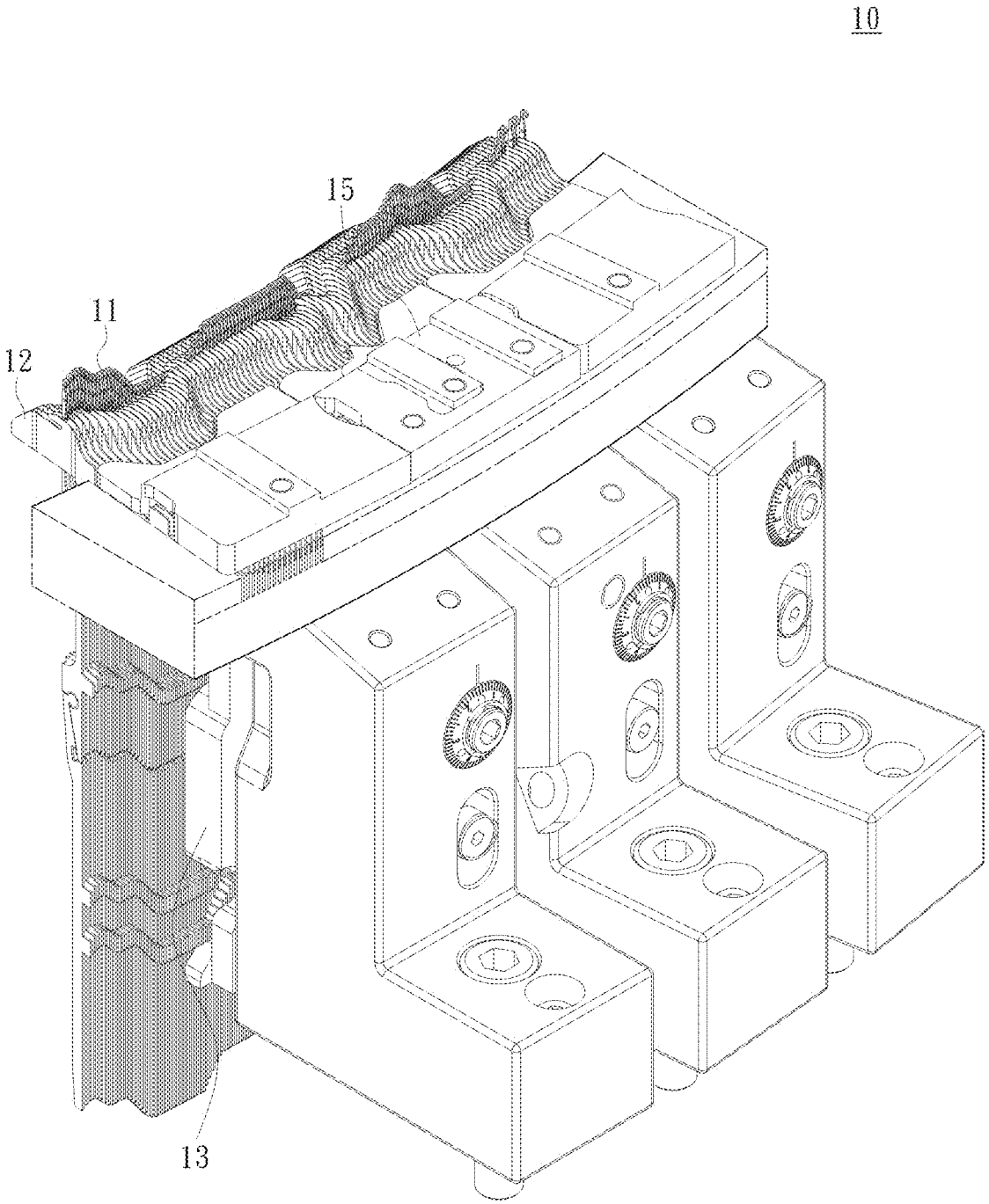
FIG. 1 is a schematic diagram of a circular knitting machine structure in one embodiment of the present invention.

The detailed description and the technical contents of the present invention are described as follows through combination with the drawings:

With reference to FIG. 1, FIG. 2, FIG. 3, FIG. 4 and FIG. 5, the present invention provides a circular knitting machine structure 10, and the circular knitting machine structure 10 comprises a plurality of knitting needles 11 and a plurality of sinkers 12. Each of the plurality of knitting needles 11 is provided with a needle hook 111 and a needle latch 112 which can be used for performing an opening-closing action relative to the needle hook 111. When each of the plurality of knitting needles 11 moves to hook yarns, the needle latch 112 is opened relatively to the needle hook 111, so that the yarns can be fed into the needle hook 111. When each of the plurality of knitting needles 11 is used for retracting, the needle latch 112 is used for performing a closing action relatively to the needle hook 111 under an affect of a former knitted plating. In the present invention, each of the plurality of knitting needles 11 is controlled to move according to one of a first half knitting track 20 and a second half knitting track 21, and a retracting time point of the first half knitting track 20 is later than a retracting time point of the second half knitting track 21. Further, the circular knitting machine structure 10 comprises one or more knitting cams 13 for defining movable paths of each of the plurality of knitting needles 11, and at least one needle selector 14 for determining movement trajectories of the plurality of knitting needles 11. The one or more knitting cams 13 can be formed by a plurality of cam blocks 131, and patterns of the plurality of cam blocks 131 are not limited to fixed patterns and are designed according to requirements of paths. In addition, the needle selector 14 is in information connection with a controller (not shown in the drawings) arranged on the circular knitting machine 10; the needle selector 14 is used for selecting the movement trajectories of the plurality of knitting needles 11 based on a signal sent by the controller according to a knitting process. That is to say, the plurality of knitting needles 11 move on the first half knitting track 20 or the second half knitting track 21, is determined by the needle selector 14 according to the signal sent by the controller.

In another aspect, with reference to FIG. 4, FIG. 5, FIG. 6 and FIG. 7, each of the plurality of sinkers 12 is arranged correspondingly to each of plurality of the knitting needles 11, the patterns of the plurality of sinkers 12 are uniform, and one side of each of the plurality of sinkers 12 facing each of the plurality of knitting needles 11 is formed with an inclined plane 121. Further, the circular knitting machine structure 10 comprises at least one sinker cam 15 guiding the plurality of sinkers 12 to move, each of the plurality of sinkers 12 is guided by the at least one sinker cam 15 to have a sinker track 22, and the sinker track 22 comprises a push-out segment 221 carried out when each of the plurality of knitting needles 11 is used for retracting and a pull-back segment 222 carried out following the push-out segment 221. It can be understood that in the present invention, a push-out time point and a pull-back time point of each of the plurality of sinkers 12 are not changed due to a movement of the plurality of knitting needles 11, namely, no matter one of the plurality of knitting needles 11 moves on the first half knitting track 20 or the second half knitting track 21, the sinker 12 coordinated thereof does not change the movement. Moreover, each of the plurality of sinkers 12 only carries out one-dimensional movement, and namely, each of the plurality of sinkers 12 is pushed out or pulled back relative to one of the plurality of knitting needles 11 only. A push-out action described by the present invention refers to that each of the plurality of sinkers 12 displaces towards feeding points of a surface yarn 30 and a bottom yarn 31, and similarly, a pull-back action described by the present invention refers to that each of the plurality of sinkers 12 displaces towards the direction distant from the feeding points of the surface yarn 30 and the bottom yarn 31. Positions of the plurality of sinkers 12 on the sinker track 22 are continuously changed and is not fixed at a single position.

Figure 5:
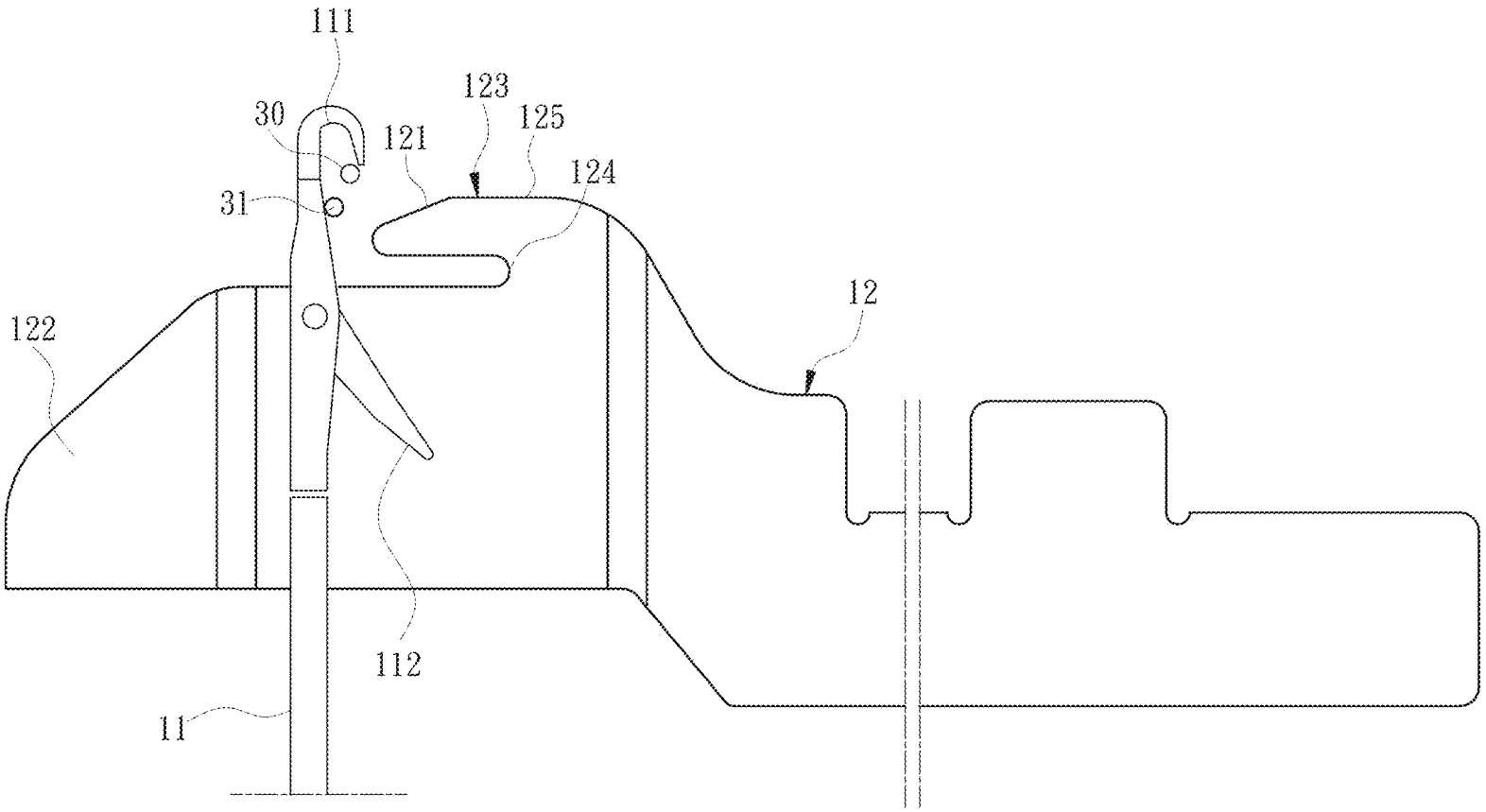
FIG. 5 is schematic diagram of implementation of the knitting needle and the sinker in the embodiment of the present invention.
Figure 6:
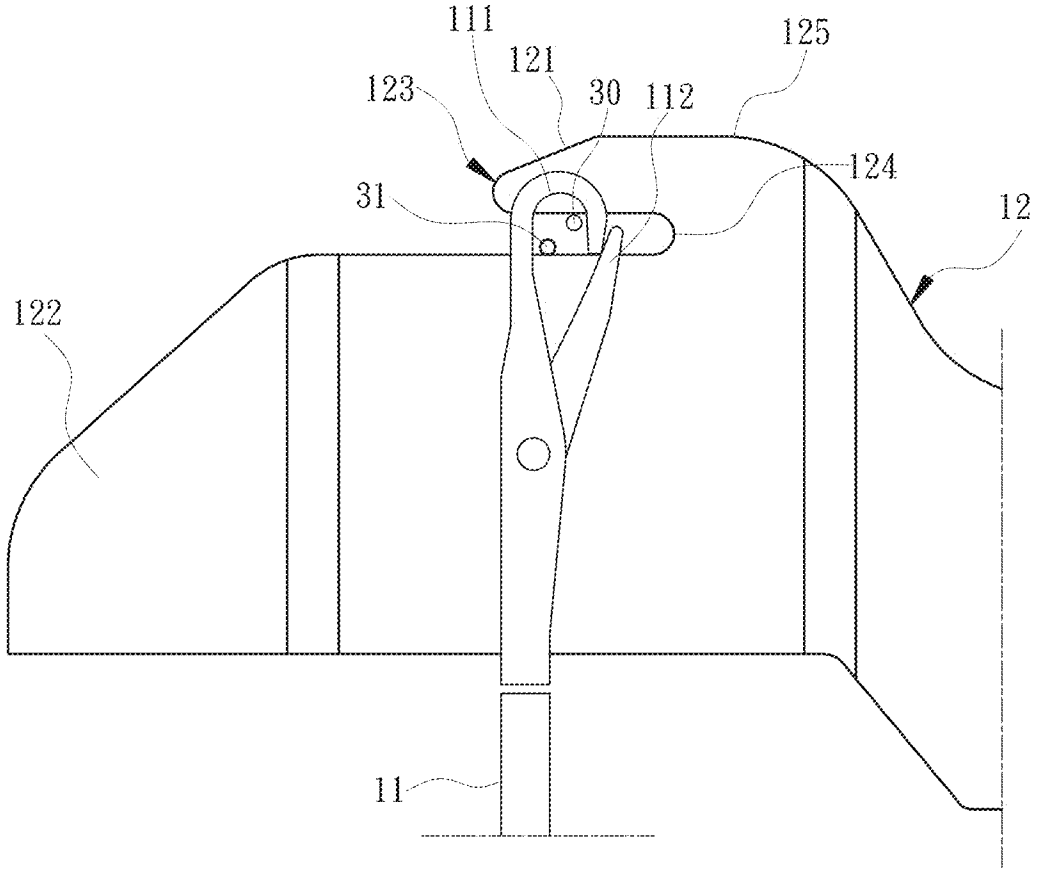
FIG. 6 is a schematic diagram of a retracting action when the knitting needle moves according to a first half knitting track in the embodiment of the present invention.
Figure 7:
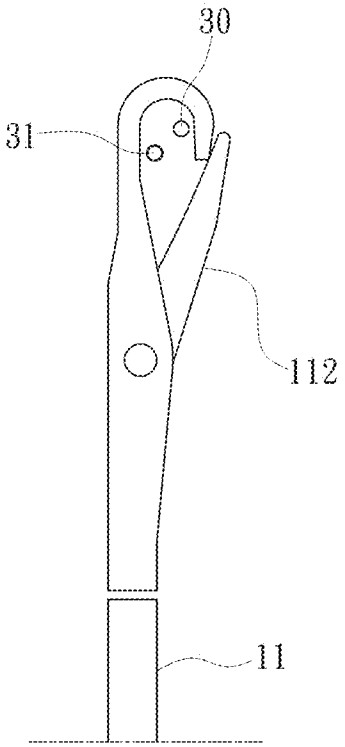
FIG. 7 is a schematic diagram of positions of a surface yarn and a bottom yarn in a needle hook when a standard plating is knitted in the embodiment of the present invention.
Figure 8:
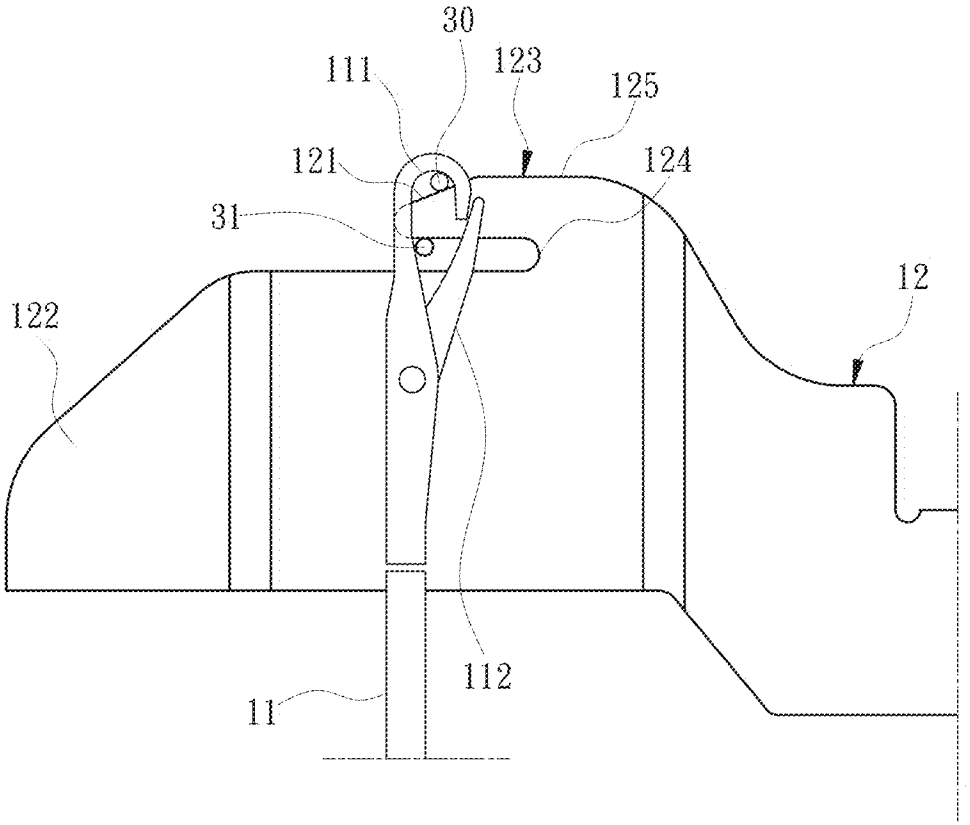
FIG. 8 is a schematic diagram of a retracting action when the knitting needle moves according to a second half knitting track in the embodiment of the present invention.
Figure 9:
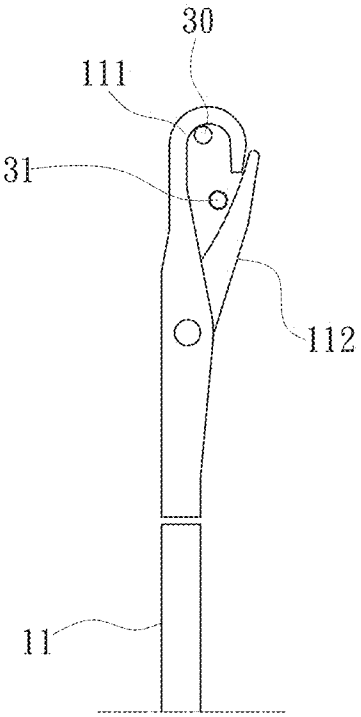
FIG. 9 is a schematic diagram of positions of the surface yarn and the bottom yarn in the needle hook when an interchanged plating is knitted in the embodiment of the present invention.
Figure 10:
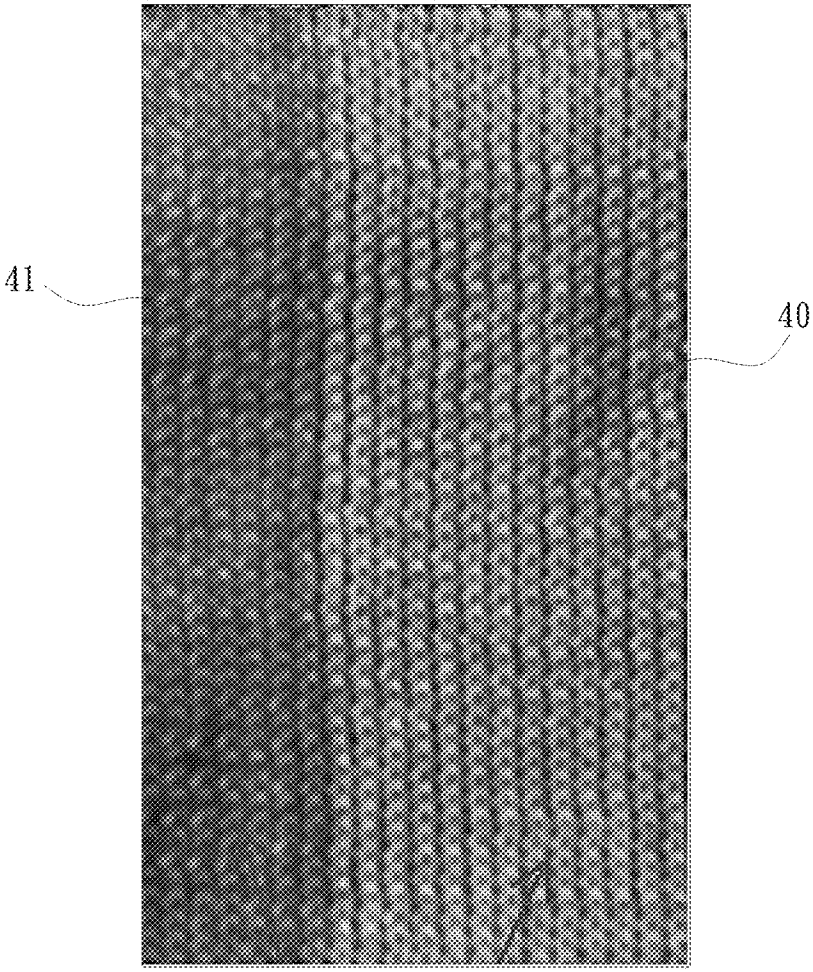
FIG. 10 is a schematic diagram of a fabric with color changing blocks in the embodiment of the present invention.

With reference to FIG. 5, FIG. 6, FIG. 7, FIG. 8 and FIG. 9, each of the knitting needles 11 is fed with the surface yarn 30 and the bottom yarn 31 upon knitting, and a position of the surface yarn 30 in the needle hook 111 is higher than a position of the bottom yarn 31. When one of the plurality of knitting needles 11 is controlled by the needle selector 14 to move on the first half knitting track 20, the position of the surface yarn 30 of one of the plurality of knitting needles 11 relative to the bottom yarn 31 is not changed in a process that is used for retracting to form a loop, as shown in FIG. 6 and FIG. 7, and a standard plating is knitted. The standard plating refers to a plating of the surface yarn 30 that is located above the bottom yarn 31, when viewing a front side of a fabric. In addition, when one of the plurality of knitting needles 11 is controlled by the needle selector 14 to move on the second half knitting track 21, in a process that one of the plurality of knitting needles 11 is used for pulling the surface yarn 30, the surface yarn 30 transitorily leans against the inclined plane 121 of one of the plurality of sinkers 12, and the inclined plane 121 enables the surface yarn 30 to slide, and change the position of the surface yarn 30 relative to the bottom yarn 31, as shown in FIG. 8 and FIG. 9, and an interchanged plating is knitted. The interchanged plating refers to a plating of the surface yarn 30 that is located under the bottom yarn 31, when viewing the front side of the fabric. The fabric knitted by adopting the circular knitting machine structure 10 of the present invention is shown in FIG. 10. Further, the present invention utilizes changing the position of the surface yarn 30 relative to the bottom yarn 31. When the surface yarn 30 is fed into the needle hook 111, the position of the surface yarn 30 is obviously higher than the position of the bottom yarn 31, and the position of the surface yarn 30 has a farer distance with a pivot junction of the needle latch 112 and the needle hook 111 than the bottom yarn 31. Therefore the surface yarn 30 is located at a wider part of the needle hook 111 so that the problem of blocking of the yarns or unsmooth interchanging of the yarns can be avoided in a process of changing the position of the surface yarn 30.

Figure 4:
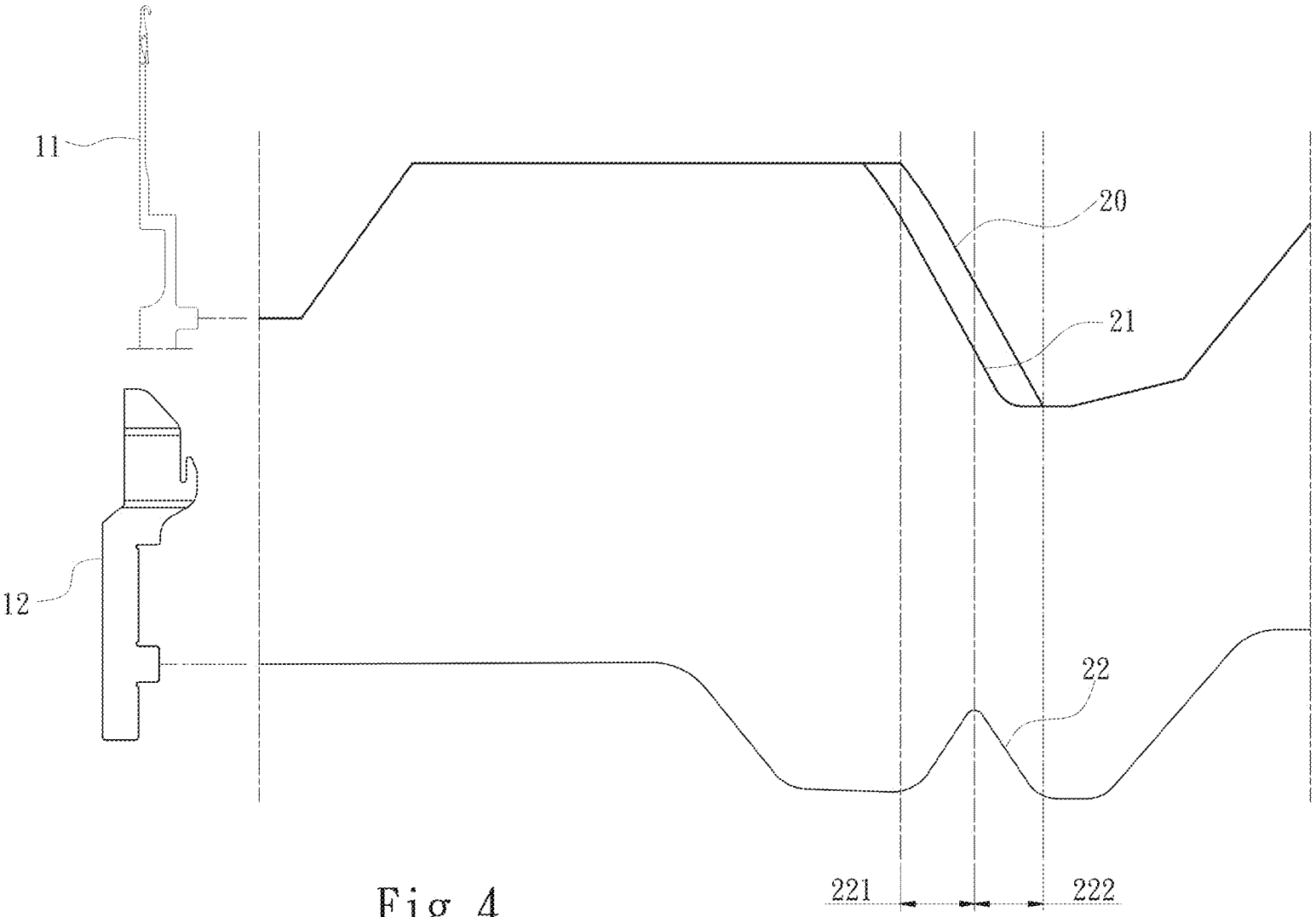
FIG. 4 is a schematic diagram of trajectories of the knitting needle and a sinker in the embodiment of the present invention.

Referring to FIG. 4 and FIG. 5, in one embodiment, each of the plurality of sinkers 12 is provided with a belly part 122, a nose part 123 connected with the belly part 122, and a throat part 124 between the belly part 122 and the nose part 123, the inclined plane 121 and a flat plane 125 connected with the inclined plane 121 are formed on one side of the nose part 123 which is distant from the belly part 122. More specifically, when one of the plurality of knitting needles 11 moves on the second half knitting track 21, one of the plurality of sinkers 12 of the present invention interferes the movement of the surface yarn 30 by the inclined plane 121 of the nose part 123 to change the position of the surface yarn 30 at a time point of the push-out segment 221 converting to the pull-back segment 222 on the sinker track 22.

Figure 2:
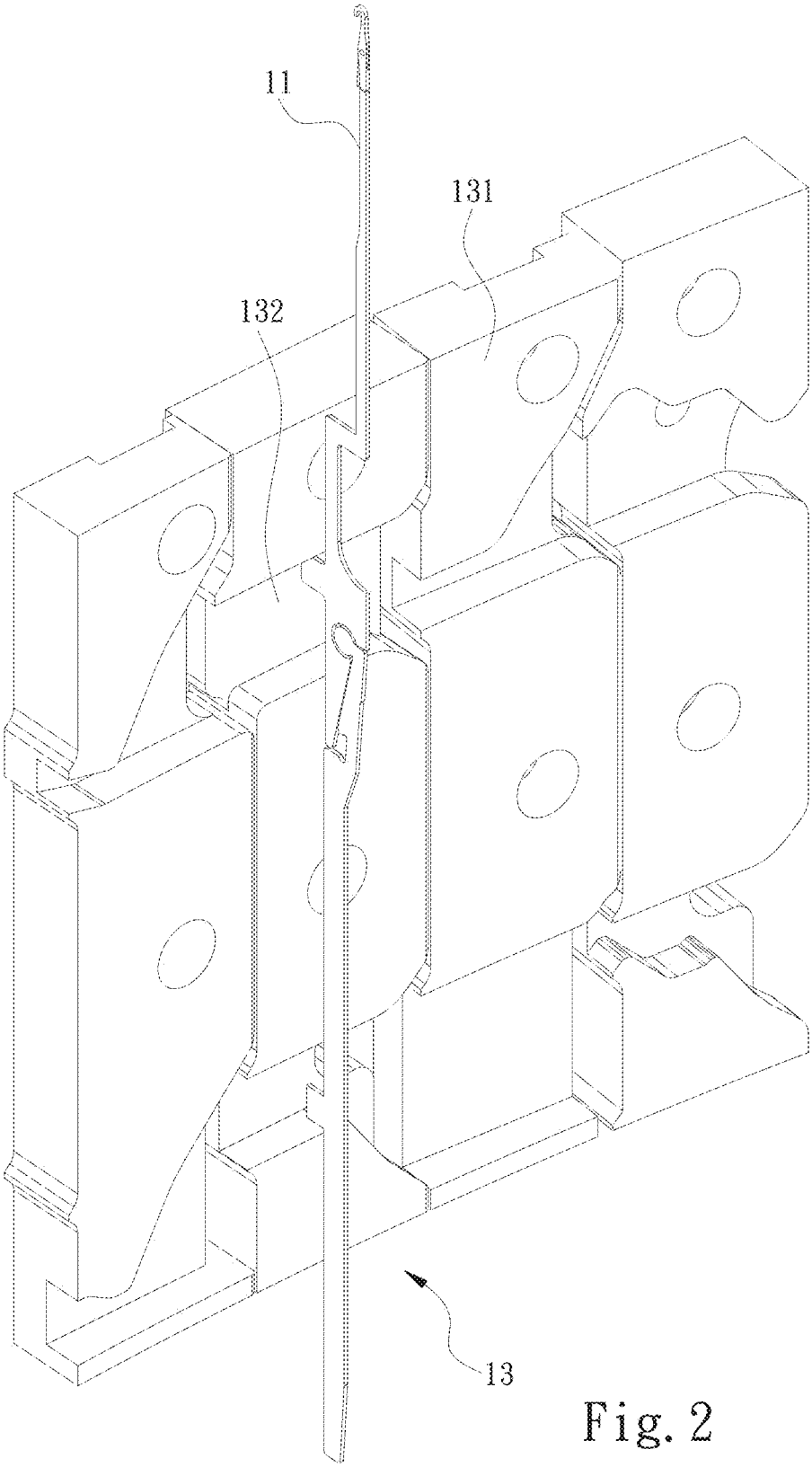
FIG. 2 is a structural schematic diagram of a knitting needle and a knitting cam in the embodiment of the present invention.
Figure 3:
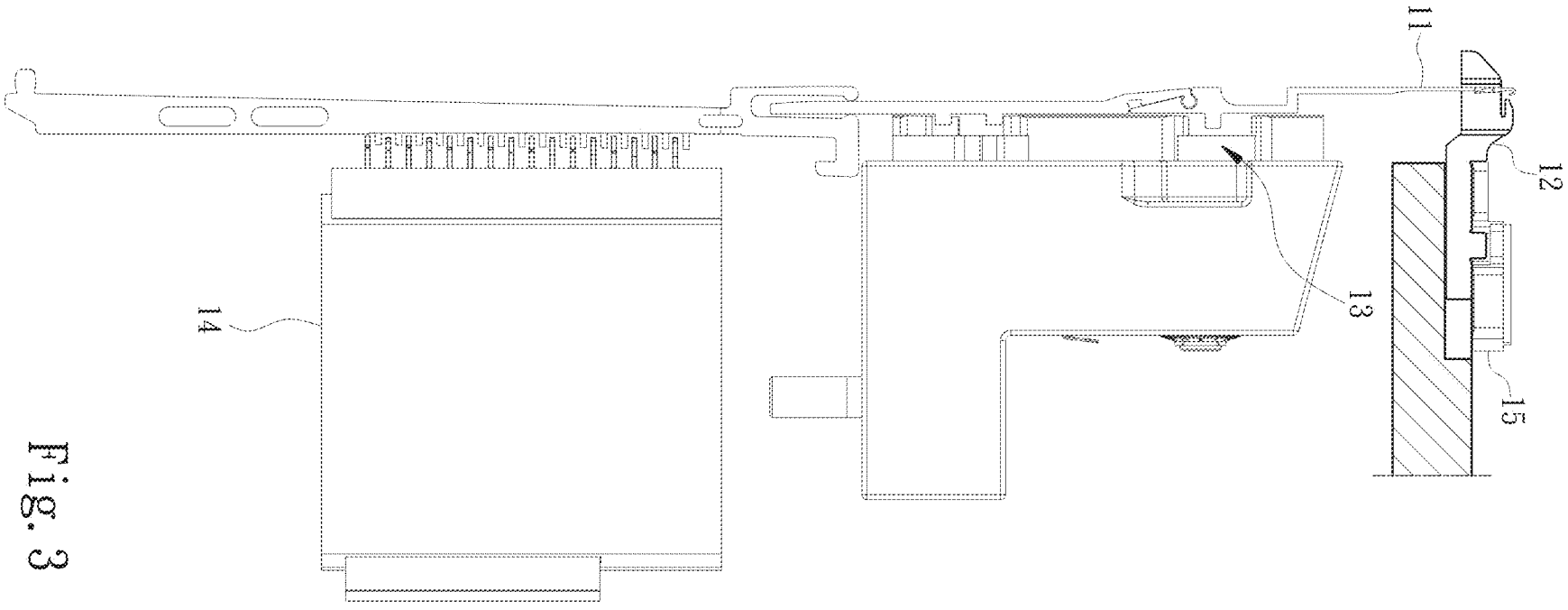
FIG. 3 is a cross-section schematic diagram of the circular knitting machine structure in the embodiment of the present invention.

With reference to FIG. 2, the plurality of cam blocks 131 included in the one or more knitting cams 13 of the present invention are different from conventional use, each of the plurality of cam blocks 131 comprises a space 132 allowing various paths to be generated, and patterns of a plurality of spaces 132 of the plurality of cam blocks 131 are not limited to the same.

Figure 11:
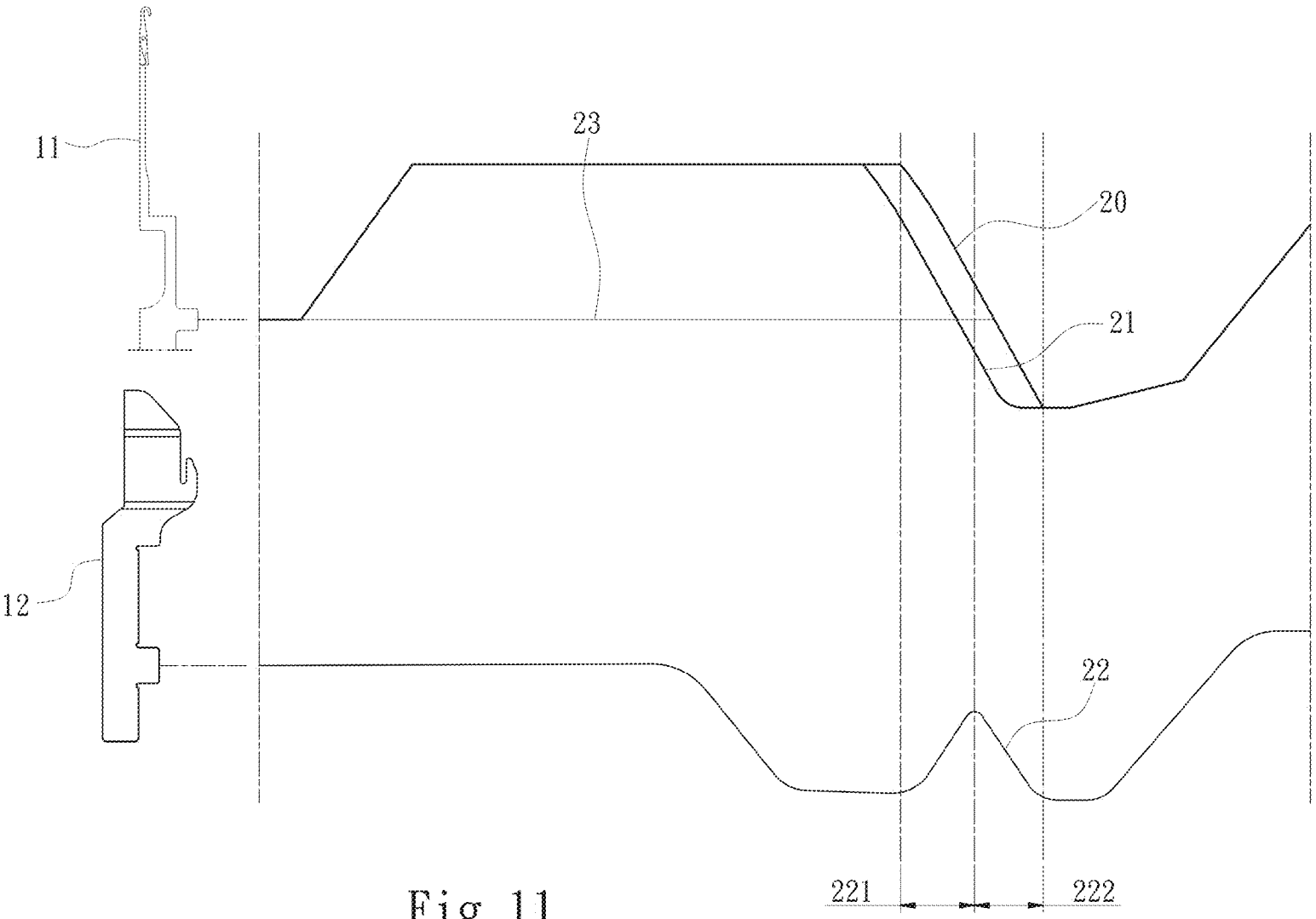
FIG. 11 is a schematic diagram of trajectories of a knitting needle and a sinker in another embodiment of the present invention.
Figure 12:
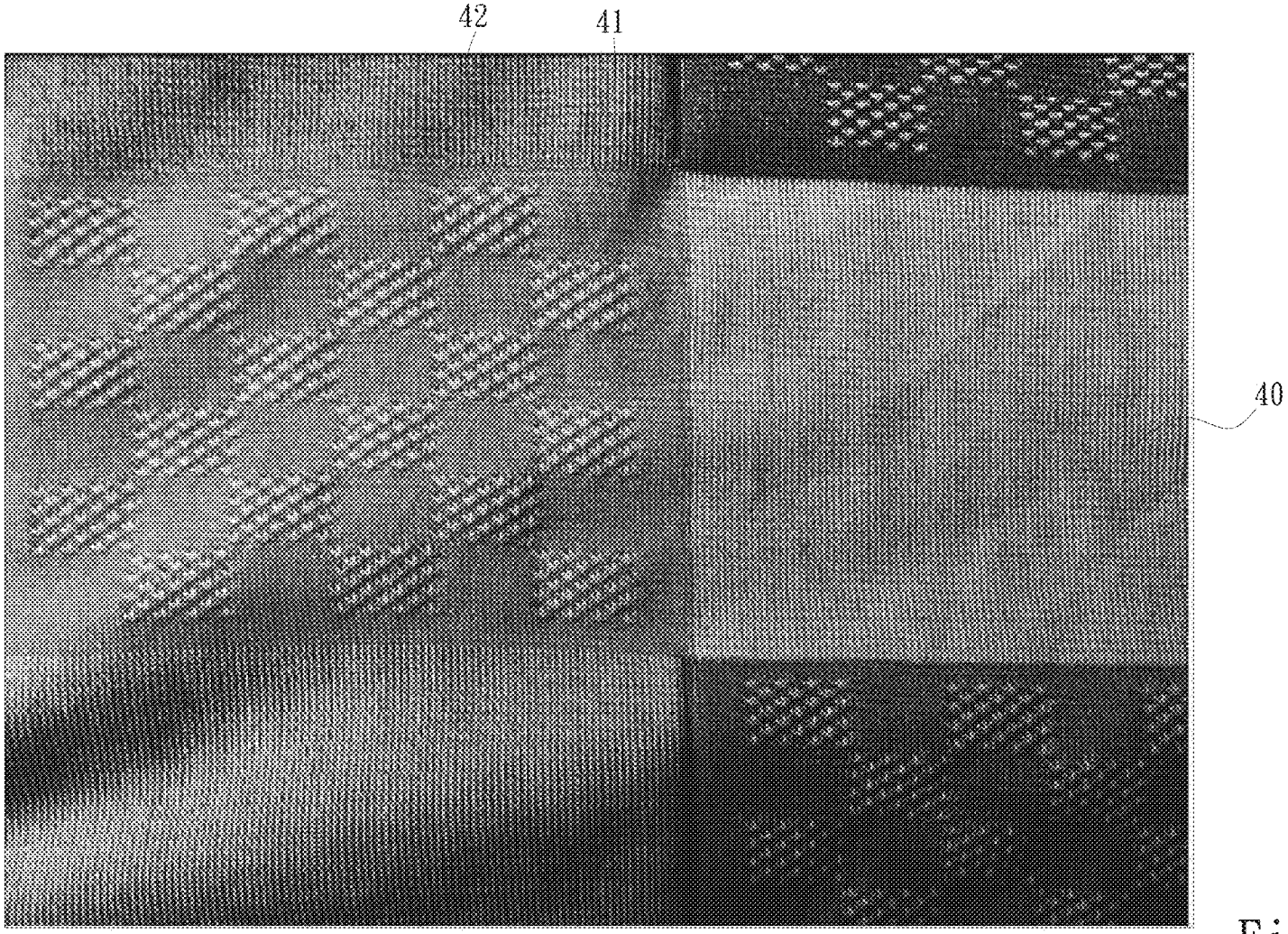
FIG. 12 is a schematic diagram of a fabric with meshes and color changing blocks in the embodiment of the present invention.

With reference to FIG. 11, in one embodiment, each of the plurality of knitting needles 11 can be controlled to move on one of the first half knitting track 20, the second half knitting track 21 and a plain knitting track 23, wherein the first half knitting track 20 and the second half knitting track 21 respectively enable each of the plurality of knitting needles 11 to hook and guide the surface yarn 30 and the bottom yarn 31 to generate a plating, and the plain knitting track 23 enables each of the plurality of knitting needles 11 to hook and guide the bottom yarn 31 to generate a plating. Therefore, when each of the plurality of knitting needles 11 is implemented on the plain knitting track 23, a mesh is generated on a fabric so that the fabric has a style besides a color changing style, and a pattern of the fabric is shown in FIG. 12, a zone 40 in FIG. 12 represent the standard plating is formed and a zone 41 in FIG. 12 represent the interchanged plating is formed, and the mesh is shown as 42 in FIG. 12 of the present invention. Therefore, the present invention can thereby generate the mesh at predetermined knitting points in a process of color changing knitting to increase the variation of the fabric.

Further, in the embodiment, although the movement of the plurality of knitting needles 11 are increased with the plain knitting track 23, the one or more knitting cams 13 used for guiding the plurality of knitting needles 11 do not need to be replaced due to the design of the plurality of spaces 132, and each of the plurality of knitting needles 11 moving on one of the first half knitting track 20, the second half knitting track 21 and the plain knitting track 23 can be controlled by the needle selector 14 only.

What is claimed is:

1. A circular knitting machine structure, comprising:

a plurality of knitting needles, wherein each of the plurality of knitting needles is provided with a needle hook, each of the plurality of knitting needles is configured to be controlled to move on one of a first half knitting track and a second half knitting track, and a retracting time point of the first half knitting track is later than a retracting time point of the second half knitting track; and a plurality of sinkers, wherein the plurality of sinkers and the plurality of knitting needles are alternately arranged, shapes of the plurality of sinkers are uniform, and one side of each of the plurality of sinkers facing each of the plurality of knitting needles is formed with an inclined plane, wherein the knitting needles are configured to be fed with a bottom yarn and a surface yarn having a position in the needle hook higher than the bottom yarn at knitting, each of the plurality of knitting needles moved on the first half knitting track is configured to knit a standard plating without changing the position of the surface yarn, and each of the plurality of knitting needles moved on the second half knitting track is configured to knit an interchanged plating with changing the position of the surface yarn relative to the bottom yarn, wherein the surface yarn is interfered by the inclined plane of one of the plurality of sinkers in the process of the surface yarn pull by the knitting needle.

2. The circular knitting machine structure according to claim 1, wherein each of the plurality of sinkers comprises a sinker track, and the sinker track comprises a push-out segment carried out when each of the plurality of knitting needles is used for retracting, and a pull-back segment carried out following the push-out segment.

3. The circular knitting machine structure according to claim 2, wherein each of the plurality of sinkers is provided with a belly part, a nose part connected with the belly part, and a throat part between the belly part and the nose part, and the inclined plane and a flat plane connected with the inclined plane are formed on one side of the nose part distant from the belly part.

4. The circular knitting machine structure according to claim 3, wherein the circular knitting machine structure is provided with at least one knitting cam for providing one of movement paths comprising the first half knitting track and the second half knitting track for the plurality of knitting needles, and at least one needle selector which is controlled to drive each of the plurality of knitting needles to move on one of the first half knitting track and the second half knitting track.

5. The circular knitting machine structure according to claim 4, wherein the circular knitting machine structure is provided with at least one sinker cam for guiding the plurality of sinkers to move on the sinker track.

6. The circular knitting machine structure according to claim 3, wherein each of the plurality of knitting needles is controlled to move on the first half knitting track, the second half knitting track or a plain knitting track.

7. The circular knitting machine structure according to claim 6, wherein the circular knitting machine structure is provided with the at least one knitting cam for providing one of movement paths comprising the first half knitting track, the second half knitting track and the plain knitting track for the plurality of knitting needles, and the at least one needle selector which is controlled to drive each of the plurality of knitting needles to move on one of the first half knitting track, the second half knitting track and the plain knitting track.

8. The circular knitting machine structure according to claim 7, wherein the circular knitting machine structure comprises at least one sinker cam for guiding the plurality of sinkers to move on the sinker track.

9. The circular knitting machine structure according to claim 2, wherein each of the plurality of knitting needles is controlled to move on the first half knitting track, the second half knitting track or a plain knitting track.

10. The circular knitting machine structure according to claim 9, wherein the circular knitting machine structure is provided with at least one knitting cam for providing one of movement paths comprising the first half knitting track, the second half knitting track and the plain knitting track for the plurality of knitting needles, and at least one needle selector which is controlled to drive each of the plurality of knitting needles to move on one of the first half knitting track, the second half knitting track and the plain knitting track.

11. The circular knitting machine structure according to claim 10, wherein the circular knitting machine structure comprises at least one sinker cam for guiding the plurality of sinkers to move on the sinker track.

* * * * *